United States Patent [19]

Fortune et al.

[11] 4,285,390

[45] Aug. 25, 1981

[54] METHOD OF AND APPARATUS FOR SUPPLYING TREATED AIR TO SPACES HAVING DIFFERENT COOLING REQUIREMENTS

[75] Inventors: Dennis M. Fortune, Longmont; Victor D. Molitor, Denver, both of Colo.

[73] Assignee: Stainless Equipment Company, Englewood, Colo.

[21] Appl. No.: 30,117

[22] Filed: Apr. 16, 1979

[51] Int. Cl.[3] ..... F25B 13/00; F24F 3/14

[52] U.S. Cl. ..... 165/2; 165/59; 165/60; 62/91; 62/309

[58] Field of Search ..... 165/19, 16, 59, 60, 165/1, 2, 3; 62/91, 304, 305, 309

[56] References Cited

U.S. PATENT DOCUMENTS

| | | | |
|---|---|---|---|
| 2,118,949 | 5/1938 | Scott | 62/91 |
| 4,125,148 | 11/1978 | Molitor | 165/2 |
| 4,129,179 | 12/1978 | Molitor | 165/101 |

*Primary Examiner*—Albert W. Davis
*Assistant Examiner*—Margaret A. Focarino
*Attorney, Agent, or Firm*—Horace B. Van Valkenburgh; Richard D. Law

[57] ABSTRACT

Fresh, outside air may be supplied to a first space, such as a dining area of a restaurant or the like, while air from the first space may be recirculated through an air conditioning unit for cooling or heating the air, which is returned to the first space. Also, air from the first space is transferred to a second space, such as a cooking room of a restaurant or the like, which contains heat producing cooking equipment, the latter resulting in the second space having additional cooling requirements. Such transfer air is passed through a chilling device, in which the air contacts water, as through sprays or a water bath, to cool the water to a temperature close to the dew point of the air, and also to correspondingly cool the air furnished to the second space. When cooling of air to the first space is required, either the recirculated air, but preferably the fresh air, is cooled by the chilled water produced by the chilling device. For heating purposes, water may be heated by the hot gases rising from the cooking equipment through a hood by which such hot gases are removed. Either the chilled water or the heated water may be transferred to a heat transfer unit for cooling or heating, respectively, the fresh air or the recirculated air. When the energy transfer unit is mounted in a position, as on a roof, in which cold outside air, as in the winter, may tend to freeze water in the unit, when the air treatment equipment is shut down, a non-freezing solution, such as aqueous ethylene glycol, may be circulated through the energy transfer unit from a protected heat exchanger through which heated or chilled water from the hood or the chiller, respectively, is circulated. Transfer air from the first space may be sent to a third space, such as other employee spaces of the restaurant or the like, either in addition to the air transferred to the second space, or first to the third space and from there to the second space. Other features are also disclosed.

14 Claims, 11 Drawing Figures

METHOD OF AND APPARATUS FOR SUPPLYING TREATED AIR TO SPACES HAVING DIFFERENT COOLING REQUIREMENTS

This invention relates to a method of and apparatus for supplying treated air to spaces, as in a building, having different cooling requirements. This invention is particularly applicable to supplying treated air to a first space and to a second space which requires additional cooling. The method and apparatus of this invention are particularly applicable to spaces in buildings having treated air requirements corresponding to those of a dining area as a first space, as in a restaurant or the like, and a cooking area as a second space, also in a restaurant or the like.

BACKGROUND OF THE INVENTION

In the Victor D. Molitor U.S. Pat. No. 4,125,148, the invention is exemplified by a hood or grease extraction ventilator provided with heat exchangers through which the hot gases pulled into the hood from above cooking equipment are utilized in heating a heat transfer liquid, which is then supplied to a heat exchanger for heating fresh makeup air. These same gases are then passed through a chilling device in which the now somewhat cool gases engage water, as in a water bath or through sprays, to cool the gases for discharge to the atmosphere, and also to chill the water through evaporation. This chilled water is then used alternatively for cooling purposes, such as to cool the same makeup air, while water initially contacting the heated gases may be passed through the heat exchanger to cool the gases prior to engaging the water to be chilled. The so cooled exhaust gases also produce a lesser pollution effect. Considerable savings can be effected by thus producing chilled water through use of exhaust gases passing through a grease extraction ventilator or hood, but such exhaust gases must still be exhausted to the atmosphere, since they are not suitable for introduction into rooms requiring treated air, because of cooking odors and the like. Also, the temperature to which such water may be chilled is limited by the dew point of the gases, which may contain a substantial amount of moisture, such as produced by cooking.

For a considerable time, in the past, so-called "swamp coolers", which are essentially devices for cooling air by passing air into contact with water to produce evaporation, had been used to cool incoming air on warm days. However, in climates in which the humidity is relatively high, the amount of cooling which may be produced is again limited by the dew point of the incoming fresh air, while the initial high humidity tends to be increased by moisture picked up through engagement with the water. Thus, in sections of the country in which the humidity may become relatively high during the summer months, the so-called "swamp cooler" has fallen into disfavor and has been replaced by mechanical refrigeration equipment which does not add to the humidity of the air cooled.

Among the objects of this invention are to provide a method of and apparatus for supplying treated air to separate spaces having different treated air requirements, wherein a second space requires additional cooling; to provide such a method and apparatus which can operate efficiently and effectively to produce cooled air for a space having additional cooling requirements; to provide such a method and apparatus which involves the use of previously treated air, whose humidity is normally not as high as outside air; to provide such a method and apparatus by which cool air may be supplied to a space in which excessive heat is a problem, such as due to cooking equipment in a cooking space; to provide such a method and apparatus which not only provides adequate cooling for the space in which excess heat is a problem, but also will provide water chilled to a temperature which can be effectively utilized in cooling other air, such as fresh makeup air from the outside; to provide such a method and apparatus which is particularly applicable to a first space having treated air requirements corresponding to those in a dining area in a restaurant or the like and a second space having treated air requirements corresponding to those in a cooking area of the like; and to provide such a method and apparatus which is efficient and effective in operation, is relatively simple to install and may be varied to provide different embodiments for different areas or spaces.

SUMMARY OF THE INVENTION

The method and apparatus of this invention includes the transfer of air from a first space, such as a dining area, to a second space which requires additional cooling, such as a cooking area. A portion of the air is removed from the first space or dining area and at least a part thereof is passed into engagement with water, so as to chill the water and also cool the transfer air which is then introduced into the second space or cooking area, while the water so chilled is passed in heat exchange relationship with other air which requires cooling, such as air to be introduced into the first space. Additional cooling of the air for the first space may be obtained by recirculation of a portion of the air from the first space through air conditioning units to cool the same and then reintroducing the treated recirculated air into the first space. The chilled water referred to above is preferably utilized in cooling fresh incoming air, which may be a particular percentage of the total air supplied to the first space, depending upon ventilation requirements. Although such chilled water may be utilized to cool air to be recirculated, the fresh incoming air is usually at a higher temperature then the air being recirculated, so that the use of the chilled water for cooling the fresh incoming or makeup air thus is desirable to provide the greatest amount of cooling possible, thereby reducing the amount of cooling necessary to be produced by the mechanical refrigeration equipment. In addition, some of the air transferred from the first space, such as a dining area, may be furnished to a third space, such as service and employee rooms in addition to the cooking room, while a portion of the treated recirculated air may be supplied to the transfer air, with flow to either or both of the second and third spaces.

The apparatus of this invention, which is particularly adapted to carry out the method thereof, may include ducts, pipes, grilles, registers, air conditioning units, such as mounted on a roof or at a position away from the spaces, as well as an energy transfer unit for heating or cooling incoming fresh or makeup air, the cooling preferably being accomplished through the aforesaid chilled water, either directly or indirectly. An important apparatus component is the air and water chilling device or chiller, by which the air is contacted by water sprays or contacts a water bath and which may be mounted in the cooking room, as on the grease extraction ventilator or hood itself, in order to discharge cool air directly into the cooking room. Or the chiller may be positioned without the cooking room but with ducts leading from the chiller to discharge the cool air through grilles or registers into the cooking room.

DESCRIPTION OF DRAWING FIGURES

Additional features and other apparatus components and method steps will be evident from the description which follows, taken in conjunction with the accompanying drawings, in which.

DESCRIPTION OF PREFERRED EMBODIMENT

Figure 1:
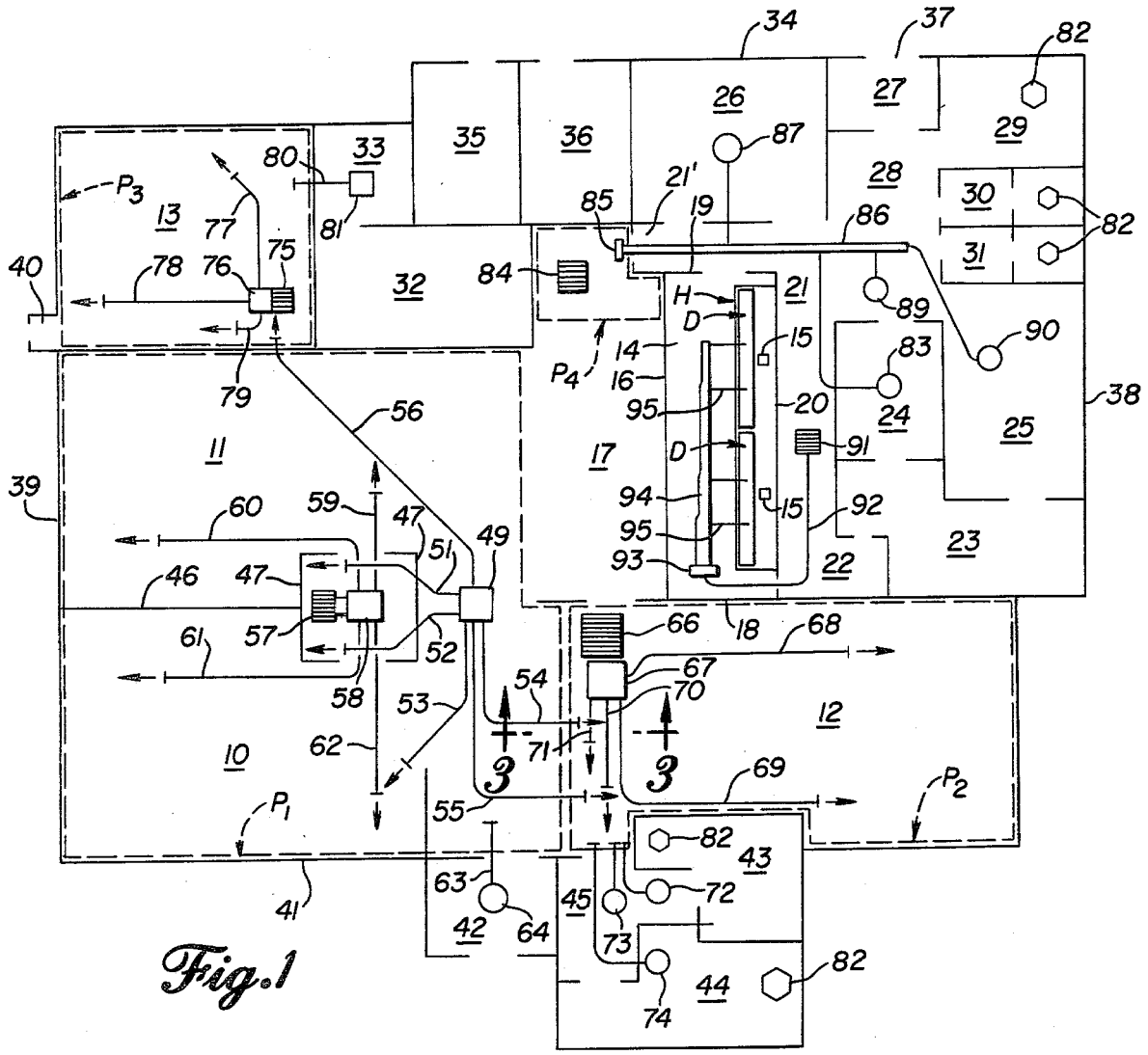
FIG. 1 is a diagrammatic plan of one floor of a building, exemplified by a restaurant, provided with equipment of, and for carrying out the method of, this invention.

As illustrated in FIG. 1, a preferred embodiment of the method and apparatus of this invention may be utilized to supply treated air to different spaces within a building particularly adapted for restaurant use, such as having a first space comprising dining rooms or areas 10, 11 and 12, and also a bar room or area 13, with a second space comprising a cooking room or area 14 in which is located a grease extraction ventilator or hood H above cooking equipment. Such cooking equipment produces heat which radiates into the room and also hot gases or vapors which are drawn off by the hood and exhausted through ducts 15 by suction produced by fans to which the ducts connect. The cooking room or area 14 may be delineated by inside partitions including, at one side, a partition 16 which separates the cooking room from a food service area 17 adjacent dining area 11 and which may be provided with suitable openings for passing prepared food to the food service area. One end of the cooking area may be bounded by a partition 18 which also separates dining area 12 from other rooms, while the opposite end of the cooking room may be bounded by a partition 19 having a door in the entrance opening shown. The other side of the cooking area may be bounded by a partition 20, which separates the former from a passageway 21 leading to a cool room 22 which connects with the passageway through a door in the opening shown and also connects with the cooking room through a door in the opening shown in partition 20. Cool room 22 also connects with a freezing room 23 through a door in the partition opening shown, while the freezing room is also accessible through doors in the partition openings shown and leading to an office 24 and a storage room 25, respectively. Other rooms or areas in that portion of the building include a dishwashing room 26, a rear foyer 27, a receiving area 28, a waste collection storage room 29 and sanitary facility rooms 30 and 31 for employees. A hallway 21', as shown, leads from the food service area 17 to the receiving area 28, past end partition 19 of the cooking room, on one side, and the dishwashing room, on the other side. Office 24, storage room 25, dishwashing room 26 and adjacent areas may comprise a third space. Adjacent the bar room 13 is a cocktail service area 32 and a bar storage room 33, while adjacent thereto but reached from the outside through doors in the entrance spaces shown, in a rear wall 34, are a mechanical equipment room 35 and an electrical equipment room 36. Rear wall 34 has a rear entrance 37 in which a rear door is installed for access to rear foyer 27, while one side wall 38 may have an offset in alignment with partition 18, and the opposite side wall 39 may have a side foyer 40 for which spaced doors are installed. The front wall 41 may have rectangular offsets providing a front foyer 42 for which spaced doors are installed in the openings shown and sanitary facilities 43 and 44 for guests, having an entranceway 45 and with doors in the spaces shown in the partitions. A parapet 46 and opposed parapets 47 separate the dining areas 10 and 11, to which air is supplied by ceiling tile apertures through which treated air flows into the areas from a plenum $P_1$ formed above the ceiling in a manner described later and the boundaries of which are indicated by dotted lines. Similarly, ceiling tile apertures supply treated air to dining area 12 from a similarly constructed plenum $P_2$ and to bar room 13 from a plenum $P_3$, the boundaries of each of which are also indicated by dotted lines.

Figure 2:
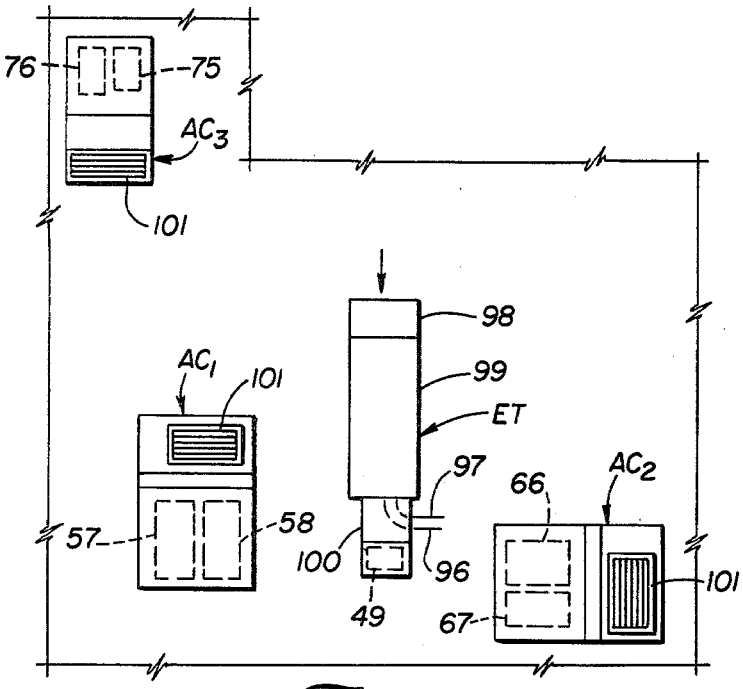
FIG. 2 is a diagrammatic, fragmentary plan view of a portion of the roof of the building of FIG. 1, on which equipment ancillary to the equipment of FIG. 1 may be installed.

In general, fresh air, cooled in the summer and heated in the winter, or heated or cooled as desired at other times, is supplied to each of the plenums from a duct 49 which is supplied by an energy transfer unit ET mounted in an appropriate position, as on the roof 50, as in FIG. 2. Thus, fresh air pipes 51, 52 and 53 may extend from duct 49 to various points in the interior of plenum $P_1$, pipes 54 and 55 to the interior of plenum $P_2$ and pipe 56 to the interior of plenum $P_3$, with the fresh air being discharged in the direction of the arrows. Fresh air duct 49 and pipes 51–56, although above the ceiling, are independent of the respective plenums, except at the point of discharge. Plenums $P_1$, $P_2$ and $P_3$ also receive treated, recirculated air, such as supplied for recirculation to plenum $P_1$, from a ceiling grille 57 through which room air flows to an air conditioning unit $AC_1$, which is mounted in an appropriate position, as directly above on the roof, as in FIG. 2, and which may be of the heat pump type and provided with heat exchangers, so as generally to cool the air in the summer and heat the air in the winter. The treated air is returned to plenum $P_1$ through duct 58 from which the air is led to various portions of the plenum, as through pipes 59, 60, 61 and 62, from which the treated air is discharged in the direction of the arrows. The purpose of the various pipes is to produce, as far as possible, a generally uniform mixture of fresh and recirculated air over substantially the entire area of the plenum. While the ceiling grille 57 and duct 58 may be adjacent, the air discharged from plenum $P_1$ is distributed over essentially the entire area thereof. In addition, a pipe 63 leads from plenum $P_1$ to a ceiling grille 64 for discharge of treated air into foyer 42.

Similarly, air for plenum $P_2$, to be treated and recirculated, flows from a ceiling grille 66 to an air conditioning unit $AC_2$, such as on the roof directly above grille 66, as in FIG. 2, thence to a return duct 67 which terminates in plenum $P_2$ and from which pipes 68, 69, 70 and 71 lead to various positions in plenum $P_2$ and discharge in the direction of the arrows. The treated air again passes through apertures in the ceiling tile, within the area of plenum $P_2$ above dining area 12, while pipes similar to pipe 63, which extends from plenum $P_1$ to the foyer, in turn extend from plenum $P_2$ to wall or ceiling registers 72, 73 and 74 for bringing a mixture of treated and fresh air into the customer sanitary facility areas 43, 44 and 45. Again similarly, recirculation air flows through a ceiling grille 75 to an air conditioning unit $AC_3$, such as on the roof directly above griller 75, as in FIG. 2, thence to a return duct 76 which terminates in plenum $P_3$ and from which the treated air is led to different positions in plenum $P_3$ by pipes 77, 78 and 79 for discharge in the directions of the arrows. From the plenum $P_3$, a single exterior pipe 80 leads to a ceiling register 81 which furnishes treated air to the bar storage room 33. Exhaust fans remove used air from sanitary facility areas 30, 31, 43 and 44 and waste storage area 29, through ducts connected to ceiling grilles 82. Such removal of air induces a flow of treated air into these rooms.

An additional plenum $P_4$, above the rear end of food service area 17, is utilized not for the distribution of treated air into the rooms, but for the collection of air from the dining area through a ceiling grille 84 for transfer to other areas. Thus, such air is supplied to a transfer fan 85 and thence to a duct 86 above the ceiling at a suitable position, as above a corridor 21'. Air is supplied from the duct through the various pipes shown, as to a grille 87 in the ceiling of dishwashing room 26, a grille 88 in the ceiling of office 24, a grille 89 in the ceiling of receiving area 28 and a grille 90 in the ceiling of storage room 25. This bypass air is utilized for the office and working areas of the establishment.

Figure 4:
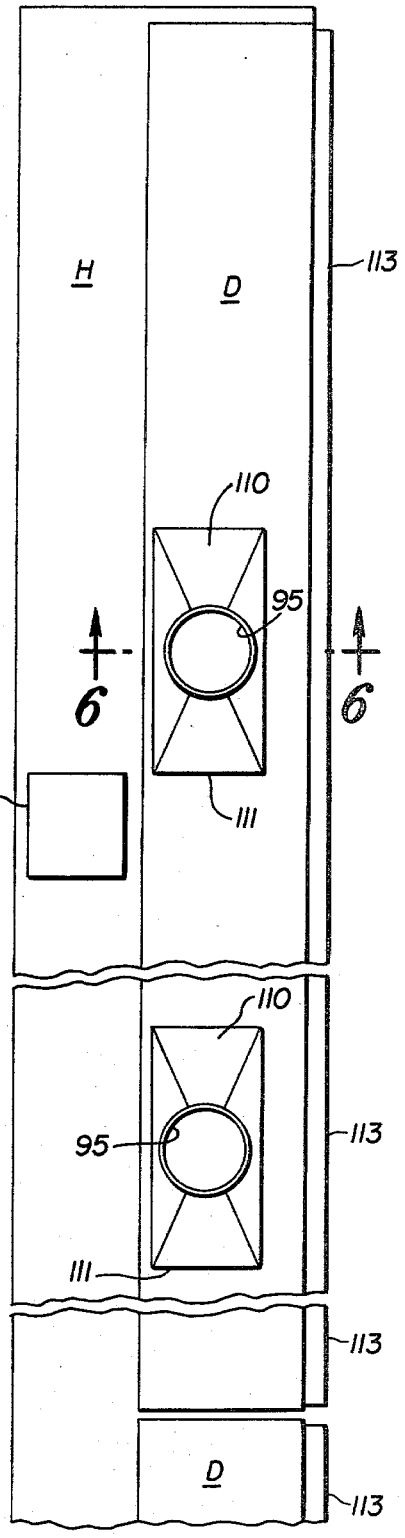
FIG. 4 is a condensed top plan view, on an enlarged scale, of a grease extraction ventilator or hood for cooking equipment shown in FIG. 1 and carrying a pair of air and water chilling devices atop the same.

In accordance with this invention, bypass air from the office and working area is received by a ceiling grille 91 above passageway 21 and conveyed by pipe 92 to a second transfer fan 93, which discharges into a duct 94 for supply through a series of spaced pipes 95, shown also in FIG. 4, to one or more, such as a pair of water contact, air chilling devices D, conveniently mounted on the hood H. The chilled air from devices D is discharged into the cooking room 14, while the chilled water produced by the devices D is supplied to the energy transfer unit ET at appropriate times and recirculated to the devices D, as through pipes 96 and 97 of FIG. 2. A suitable construction of the air chilling devices D will be described later, although when heating is called for, a heated heat exchange liquid, such as water, may be supplied from heat exchangers in the hoods H and is heated by the heated gases and vapors received from the cooking equipment beneath the hood. In the case of an energy transfer unit mounted on a roof top, or otherwise exposed to the outside temperature, particularly during very cold weather, when the building is substantially unoccupied and there is no flow through the energy transfer unit, as during late evening and erly morning hours, a problem of freezing water in the energy transfer unit may arise. Draining water from the heat exchangers in an energy transfer unit is usually a rather tedious undertaking and also tends to be overlooked by persons accustomed to automatic operation of air temperature and humidity regulating equipment. Thus, in lieu of passing water from the heat exchangers in the hood H or the air chilling devices D, directly to and from the energy transfer unit, the best mode of carrying out this invention may be provided by utilizing the individual invention of Victor D. Molitor, which includes the use of an additional or auxiliary set of hea. exchangers of a liquid to liquid type, such as disclosed in the Victor D. Molitor U.S. application Ser. No. 920,660 filed June 30, 1978 and now abandoned. Thus, an antifreeze solution, such as an aqueous ethylene glycol solution, is circulated between the energy transfer unit and the shell of one or more auxiliary heat exchangers, through the tubes of which is circulated water from the heat exchangers in the hood H, for heating purposes, or alternatively, from the air chilling devices D, for cooling purposes. Although the additional transfer through the use of the antifreeze solution is normally unnecessary during the summer months, when cooling is normally required, the antifreeze solution may be necessary during the winter months, when heating is required, to prevent freezing of the liquid in the energy transfer unit exposed to low outside temperatures during periods when there is no flow of liquid through the heat exchangers and the energy transfer units because the system is shut off. Although an antifreeze solution could be used for the heat exchangers in the hood H only and the energy transfer unit, it would be necessary to drain this solution from the energy transfer unit when the chillers are to be used. This is not only inconvenient, on a periodic basis, but also so inconvenient as to be prohibitive during periods in the fall and winter when heating might be called for at one time of the day and cooling at another. The use of the antifreeze solution and liquid to liquid heat exchangers also permits a simple control of alternation between heating and cooling, as described later and illustrated in FIG. 7.

The energy transfer unit ET of FIG. 2 may be provided with an air intake 98, into which air flows in the direction of the arrow, and a fan for conveying fresh air through a series of heat exchangers in a housing 99, with duct 49 connecting a discharge section 100. Each of the air conditioning units $AC_1$, $AC_2$ and $AC_3$ may be provided with a grille 101 for flow of air to cool a motor, condenser or the like, as well as a conventional device for removing excess moisture from the treated air. These units are commercially available, such as the General Electric Model Nos. BYC120D330A, BYC090D324A and BYC060B316B, respectively.

Figure 3:
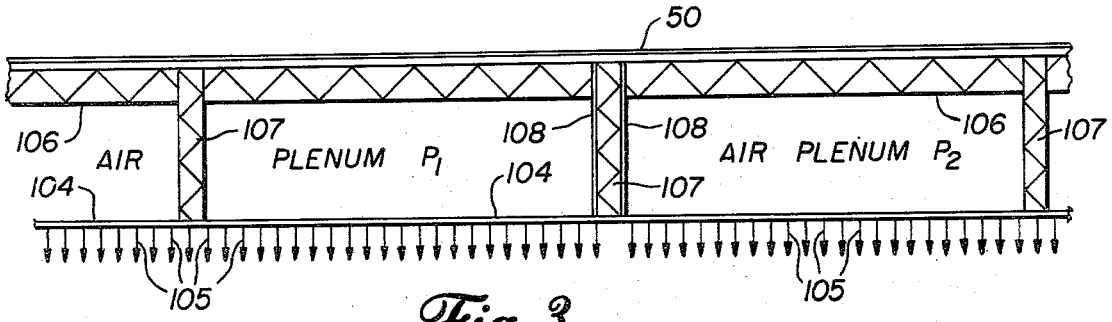
FIG. 3 is a cross section of the area between a ceiling and the roof of FIG. 2, taken at the position of line 3—3 of FIG. 1.

The plenums $P_1$, $P_2$, $P_3$ and $P_4$ may be constructed essentially in the manner illustrated in FIG. 3, such as between roof 50 and ceiling 104 having numerous apertures through which air flows downwardly, as indicated by arrows 105, although ducts or pipes and grilles could be utilized in lieu thereof. The roof 50 is supported by trusses 106, from which struts 107 depend, for suspending the ceiling. The struts 107 may, of course, be constructed in essentially the same manner as the trusses 106. At appropriate struts 107, upright layers 108 of plasterboard or the like may be attached to and extend along the struts to form the boundary of the respective plenum. As shown in FIG. 3, the boards 108 extend between opposite sides of a strut 107 or a series of struts, in order to form the adjacent boundaries of the plenums $P_1$ and $P_2$. The other sides of plenums $P_1$ and $P_2$, as well as the sides of plenums $P_3$ and $P_4$, may be constructed in a similar manner.

Figure 5:
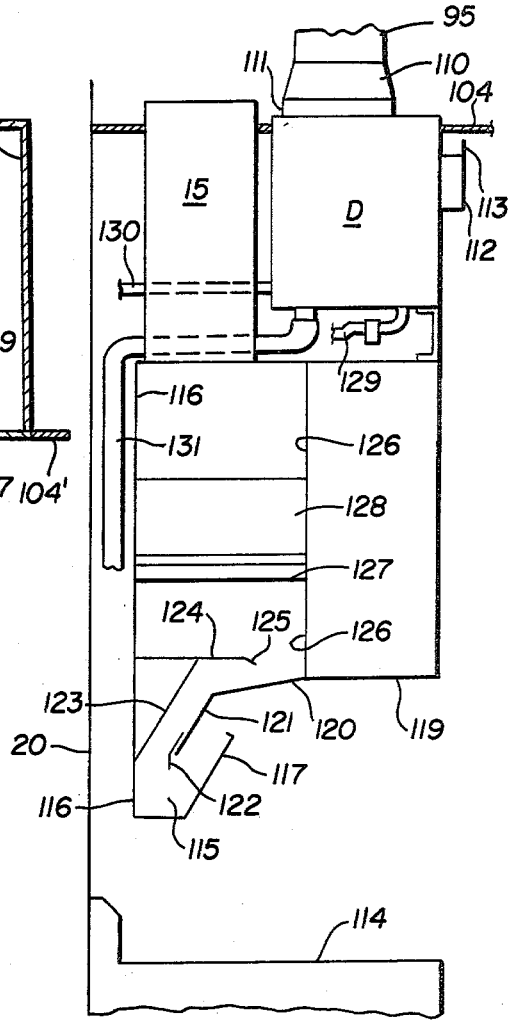
FIG. 5 is an end view, partly in vertical section, of the hood of FIG. 4.

The air and water chilling devices D mounted atop the hood H, as in FIG. 4, are connected at the top, each to a pair of pipes 95, by a downwardly expanding connector 110, which assists in distributing the air within the interior of the chiller from a circular pipe 95 through the rectangular air inlet 111 of the chiller, shown also in FIG. 5. Each device D is also provided with a channel-shaped, perforated outlet 112 mounted on the underside of an inverted channel 113, which may be disposed just below ceiling 104. Although described more specifically later, this perforated outlet faces toward the room, so as to blow cooled air toward the opposite side of the room in an upper area thereof and also to direct air downwardly toward the persons operating the cooking equipment. Each duct 15, extending upwardly at the rear of the hood for withdrawing exhaust gases, as well as each device D, extends through a suitable aperture in the ceiling 104 of the room. As also shown in FIG. 5, the hood H is mounted above cooking equipment 114, which may be a range, stove, broiler or the like, and which normally extends to the partition 20, while the hood H is spaced forwardly from the partition. The hood H is conveniently constructed pursuant to U.S. Pat. No. 3,841,062 with the slight modification disclosed in U.S. Pat. No. 4,129,179, thus having a water bath chamber 115 between a rear wall 116 of the hood and a forwardly inclined front wall 117 of the chamber, which has a circular curl at its upper end, over which hot gases and air flow into the chamber. An equipment and control compartment 118 is disposed forwardly of and above the position of the water bath compartment, the lower edge 119 of which intercepts upwardly flowing gases. A continuation of the lower edge, extending rearwardly and downwardly, forms an entrance baffle 120 for the water bath compartment, while a depending baffle 121 extends at a sharper angle into the water bath compartment and is provided with an adjustable, obtusely angled lower lip 122, the position of which may be adjusted to control the impingement of the gases against the water bath. As the gases engage the water bath, they flow around the lower end of lip 122 and move upwardly into engagement with an upwardly inclined, forwardly extending baffle 123, the lower edge of which is connected to the rear wall 116 and the upper edge of which is connected to the underside of a horizontal plate 124 having a downwardly inclined lip 125 on its front end, which tends to strip droplets of moisture from the gases as they pass around the lip. As the gases flow upwardly into the space above plate 124, between rear wall 116 and a passage front wall 126, they encounter a filter 127 and then a heat exchanger 128 by which the heat of the hot gases is transferred to a heat exchange liquid, such as water. A series of heat exchangers 128 is placed longitudinally of the hood and each is conveniently constructed in the manner of U.S. Pat. No. 4,071,935 or variations thereof disclosed in the Victor D. Molitor application Ser. No. 11,402 filed Feb. 12, 1979, a continuation-in-part of a prior application, in turn a division of the application which matured into the above U.S. patent. After passage through the heat exchangers, the gases then may flow upwardly through the passage to exhaust duct 15. The water heated by the heat exchangers 128, when heating of the building is required, may be transferred to the energy transfer unit ET, while the chilled water produced by each chilling device D, when cooling is required, is instead transferred to the energy unit, as through a pipe 129. When heating is being accomplished, the heat transfer liquid, after heat exchange, is returned to the heat exchangers 128, but if cooling is accomplished, the heat transfer liquid is returned to the chiller D, as through a pipe 130. An overflow drain pipe 131 removes surplus water, although sufficient makeup water may be supplied to chilling device D to compensate for losses due to evaporation in the chilling device, and also normal losses in the system.

Figure 6:
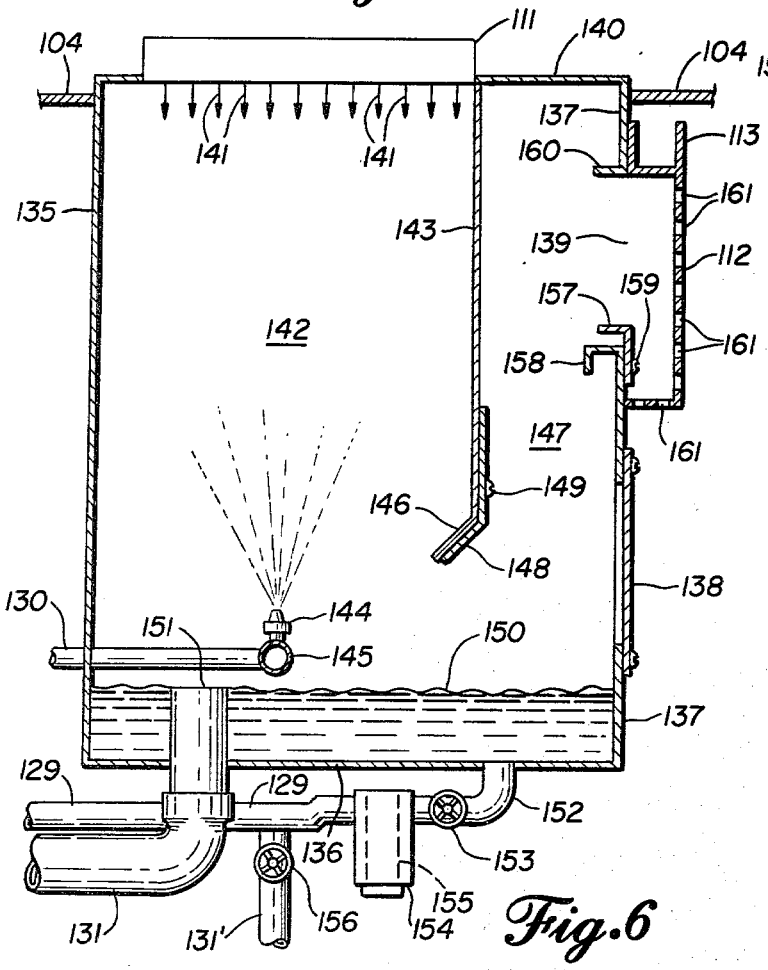
FIG. 6 is a vertical section, taken along line 6—6 of FIG. 4 but on an enlarged scale of an air and water chilling device of FIG. 4.

Each chilling device D, as in FIG. 6, may include a rear wall 135, a bottom wall 136 and a front wall 137 having a removable access cover plate 138 and also providing a discharge slot 139, while a top wall 140 has appropriate apertures for the inlet connections 111. These walls extend between appropriate end walls. The incoming air flows downwardly as indicated by the arrows 141, and expands slightly laterally but considerably longitudinally, in a water contact compartment 142 between rear wall 135 and a depending baffle 143. As the air thus moves downwardly, it is contacted by water sprayed by a series of nozzles 144, each of which produces a spray which fans out both laterally and longitudinally, so that the entire area of the interior of the water contact compartment of the chiller may be covered, as by ten nozzles in a length of eleven feet. Nozzles 144 are mounted on a distribution pipe 145 which extends longitudinally of the device and centrally of the water contact compartment. Water for the nozzles is supplied by return pipe 130, as from the energy transfer unit or auxiliary heat exchanger. Baffle 143 is provided with a depending lip 146 extending angularly toward the nozzles, to force the air to pass around the lower edge of lip 146 in passing from the water contact compartment 142 to a discharge compartment 147. The lower end of baffle 143 may be provided with an anuglar, adjustable lip 148, which is shown as slightly separated from the fixed lip 146, for clarity of illustration, but the normal position of which is abutting the fixed lip. However, when a series of screws 149 is loosened, adjustable lip 148 may be moved downwardly below the position shown, to decrease the area through which the air moves in passing from the water contact compartment and the discharge compartment above the water level 150, determined by an adjustable overflow pipe 151, which is connected to drain pipe 131. Also, lip 146, or lip 148 when adjusted downwardly, tends to strip droplets of moisture from the air moving around it. The chilled water is discharged through an outlet connected to an outlet pipe 152 having a shut-off valve 153 therein and leading to a filter housing 154 having a removable screen 155 therein. After passage through the filter, the chilled water passes to discharge pipe 129. Valve 153 is normally open but is closed when screen 155 is to be removed for cleaning, then replaced. A drain pipe 131', having a shut-off valve 156 therein, may be connected to the underside of pipe 129, so that valve 156, which is normally shut, may be opened to drain all of the water from chilling device D, as for cleaning by flushing with a detergent or other appropriate solution.

From the discharge compartment 147, the chilled air moves through outlet aperture 139, the height of which may be adjusted. Thus, the position of an angular plate 157, the horizontal leg of which extends into outlet opening 139 and the lowest position of which is the dotted one against an inwardly extending flange 158 of the front wall, but is shown in spaced position for clarity of illustration, can be adjusted by loosening and then tightening, after adjustment of the position of plate 157, a series of adjustment screws 159. An inwardly extending flange 160 of front wall 137 extends along the upper edge of outlet 139. From outlet 139, the chilled air flows through the channel-shaped diffuser 112 having a large number of holes 161 which cause air to flow outwardly into the room at an upper level, and also settle downwardly below the upper level, as well as some air to discharge downwardly through the perforations in the lower flange of the diffuser. The diffuser 112 may be removably mounted on the outside of wall 137 or may be adjustably mounted in a suitable manner to permit an opening above it to increase the flow of air just under the ceiling of the room.

It will be noted that the temperature and relative humidity of the incoming air determines the temperature to which the air and water may be chilled, since the water may be chilled to a temperature approaching the dew point of the incoming air and the air to a corresponding temperature. For instance, incoming air at 76° F. dry bulb, but 66° F. wet bulb, may chill the water to a temperature of about 67° F. As will be evident, the air leaving the chilling device will be at a temperature slightly higher than but generally corresponding to the temperature to which the water in the chilling device has been chilled.

Figure 7:
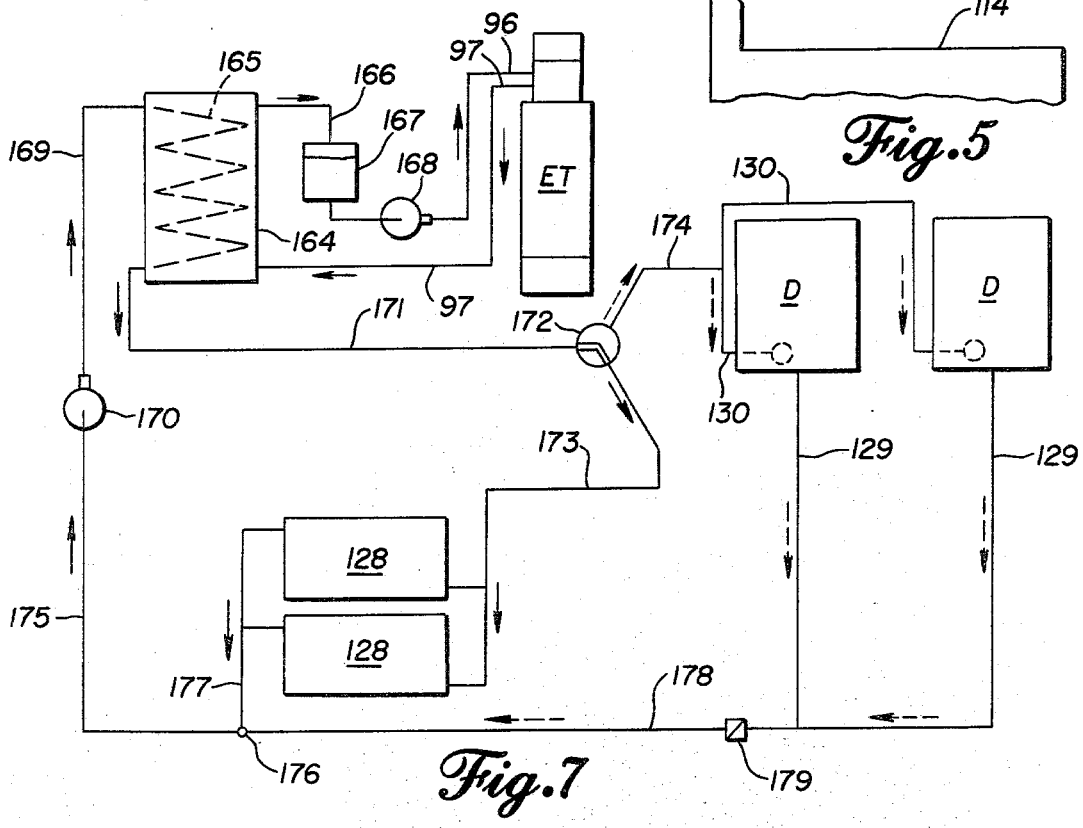
FIG. 7 is a diagram of a control arrangement useful for the equipment.

An appropriate arrangement for changing over readily from supplying heat to the incoming air in energy transfer unit ET or supplying cooling thereto and, at the same time, obviating the possibility of freezing water in the heat exchangers of the energy transfer unit, is shown in FIG. 7. The energy transfer unit ET may be connected through pipes 96 and 97 with a heat exchanger 164, such as of the liquid to liquid type previously referred to, to supply to and return from unit ET a heat transfer liquid which will not be subject to freezing, such as an ethylene glycol aqueous solution. Such a heat transfer liquid flows from the energy transfer unit through pipe 97 and through a spiral path formed by tubes 165 of heat exchanger 164, then through a pipe 166 into a reservoir 167, which maintains an adequate supply of non-freezing solution, thence to a pump 168, for return to the energy transfer unit through pipe 96. Water for heating or cooling the antifreeze solution is circulated through tubes 165 of heat exchanger 164, in heat exchange relationship with the antifreeze solution, being supplied through a pipe 169 and the circulation being maintained by a pump 170, while the water which has been cooled or warmed by the transfer, as the case may be, is returned through a pipe 171 to a three-way valve 172. In one position, three-way valve 172 connects pipe 171 with a pipe 173, so that the return water will flow to the heat exchangers 128, as in hood H, the flow being in the direction of the solid arrows. In the opposite position, three-way valve 172 connects pipe 171 with a pipe 174, which, in turn connects with pipes 130 for supplying the return water to the nozzles of the air and water chilling devices D, this alternative flow being indicated by the dotted arrows. A suction pipe 175 for pump 170 extends to a junction 176, to which a branch discharge pipe 177 for the heat exchangers 128 and a branch discharge pipe 178 for the chilling devices D are connected. Thus, flow will be in the direction of the solid arrow through pipe 177 to junction 176 and thence to pump 170 when three-valve 172 connects pipe 171 with pipe 173. Similarly, when three-way valve 172 is turned to the opposite position, flow will be in the direction of the dotted arrows through outlet pipes 129 of the chilling devices and pipe 178 to junction to provide chilled water from the chilling devices D through pipe 175 to pump 170. The action of three-way valve 172 in the first position above and flow through branch pipe 177 to junction 176 is essentially the result of the pressure produced by pump 170 pushing water through pipe 169, through tubes 165 of heat exchanger 164, thence through pipe 171 to valve 172 and through pipe 173 to the heat exchangers. This pressure will be effective in the heat exchangers and will push water nearly through the heat exchangers, while suction from pump 170 will cause a flow in branch pipe 177 through pump suction pipe 175. With the three-way valve 172 in a position to cause flow through pipe 173, in the direction of the solid arrows, there is no pressure in the supply pipes 130 for the chilling devices D, so that flow through the nozzles thereof will be terminated when the three-way valve 172 is switched to pipe 173, although chilling devices D, being at a higher elevation than heat exchangers 128, as in FIG. D, act as a reservoir to maintain the system full of water. Thus, a loss of water at junction 176 will cause a flow through a pipe 178 from chilling devices D to junction 176, past a check valve 179 which normally prevents a higher pressure in pipe 177 from producing a back up of water in the chilling devices. Thus, makeup water may continue to be supplied to the chilling devices. Conventional air-water separators (not shown) at the top of each heat exchanger 128 and at the top of pipes 96 and 169, i.e. at the highest point in each pressure system, bleed from the system any air which may have accumulated therein. Similarly, when the three-way valve 172 is shifted from pipe 173 to pipe 174, to produce flow in the direction of the dotted arrows, the pressure produced by pump 170 causes flow through pipe 169, heat exchanger tubes 165, pipe 171 and through pipe 174 to the nozzles 144 in chilling devices D, to supply water to contact the air being discharged into the chilling devices to cool the air, as well as water. This provides chilled water for flow through the outlet of the chilling devices, thereby supplying pipe 178 with chilled water under suction from pump 170. It will be noted that, when water is not being supplied to the nozzles of the chilling devices D, air still may flow through them, for distribution into the cooking room, but with very little water evaporation and thus very little cooling. However, when the remaining equipment is required to operate in a heating phase, there should be little necessity for further cooling the air introduced into the cooking area.

Since bursting of coils in heat exchangers of an energy transfer unit ET may result from a shutdown and a slight freeze of residual water which causes a few to become clogged, but a hard freeze when very cold air is blown through the unit before resumption of circulation of warm water can thaw the clogged areas, another manner in which the freezing problem might be counteracted would be to place a damper at the inlet of the unit ET and a control for the damper which is responsive to the temperature of the water being discharged, as through pipe 97, of FIG. 2. Thus, such a damper would prevent air being blown through the heat exchanger until the water being discharged reached a temperature sufficiently above 32° F. that thawing of all temporarily slightly frozen spots would have been accomplished.

Figure 8:
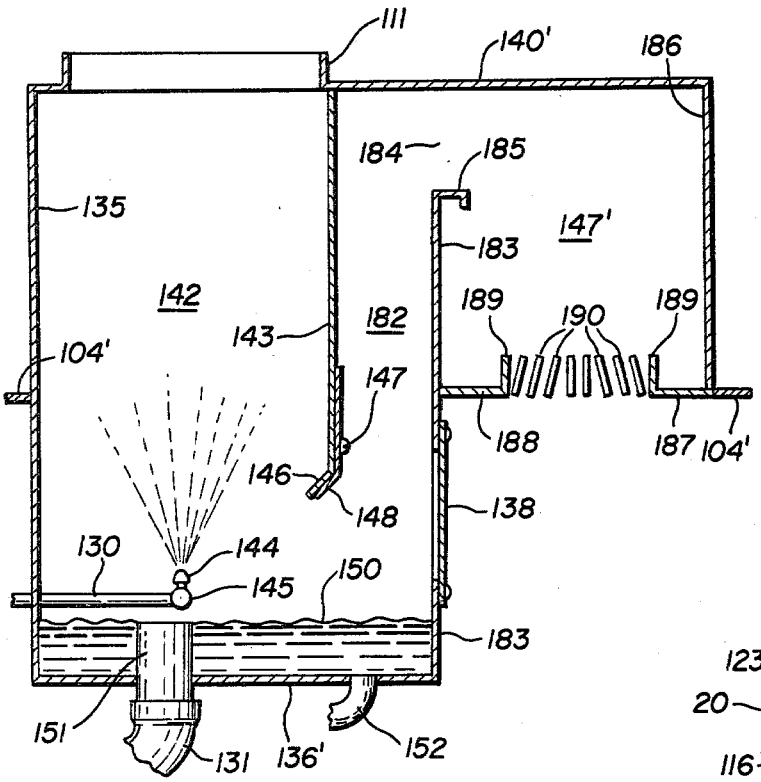
FIG. 8 is a vertical section, similar to FIG. 6, of an alternative air and water chilling device.

In the alternative chilling device D' of FIG. 8, which is designed for a cooking room in which the ceiling 104' is at a lesser height relative to the top of hood H, certain parts of device D' are generally similar to those of chilling device D of FIG. 6, including the inlet duct 109, rear wall 135, water contact compartment 142, baffle 143 and associated lips, distribution pipe 145 nozzles 144, overflow pipe 151 and drain and outlet pipe 152 and associated parts. Top wall 140' is wider, to accommodate a passage 182 between baffle 143 and an intermediate wall 183 having an access plate 138 but extending upwardly to an opening 184 immediately below top wall 140' and leading into an oulet chamber 147'. The upper end of wall 183 may be provided with an angular flange 187 extending into outlet chamber 147', while wall 183 provides the rear wall of chamber 147'. A front wall 186 of chamber 147' depends from the front edge of top wall 140', extending to a horizontal plate 187, while another horizontal plate 188 is aligned with plate 187 and attached to wall 183 to provide the bottom wall of chamber 147'. Plates 187 and 188 are spaced apart to provide an opening between them and have an upstanding flange 189 at each edge of the opening. Disposed within this opening is a set of pivotally adjustable, generally upright louvers 190 which may be turned to different angular positions to direct cooled air directly downwardly, downwardly and rearwardly toward the cooking equipment or downwardly and forwardly into the cooking room. As shown, some of the baffles are adjusted to direct cool air downwardly and rearwardly toward the cooking equipment, others directly downwardly and still others downwardly and forwardly into the room. It will be understood, of course, that the directional arrangement of the louvers may be varied considerably from that shown. It will be further understood that the chilling device D', as before, is provided with appropriate end walls.

Figures 9, 10, 11:
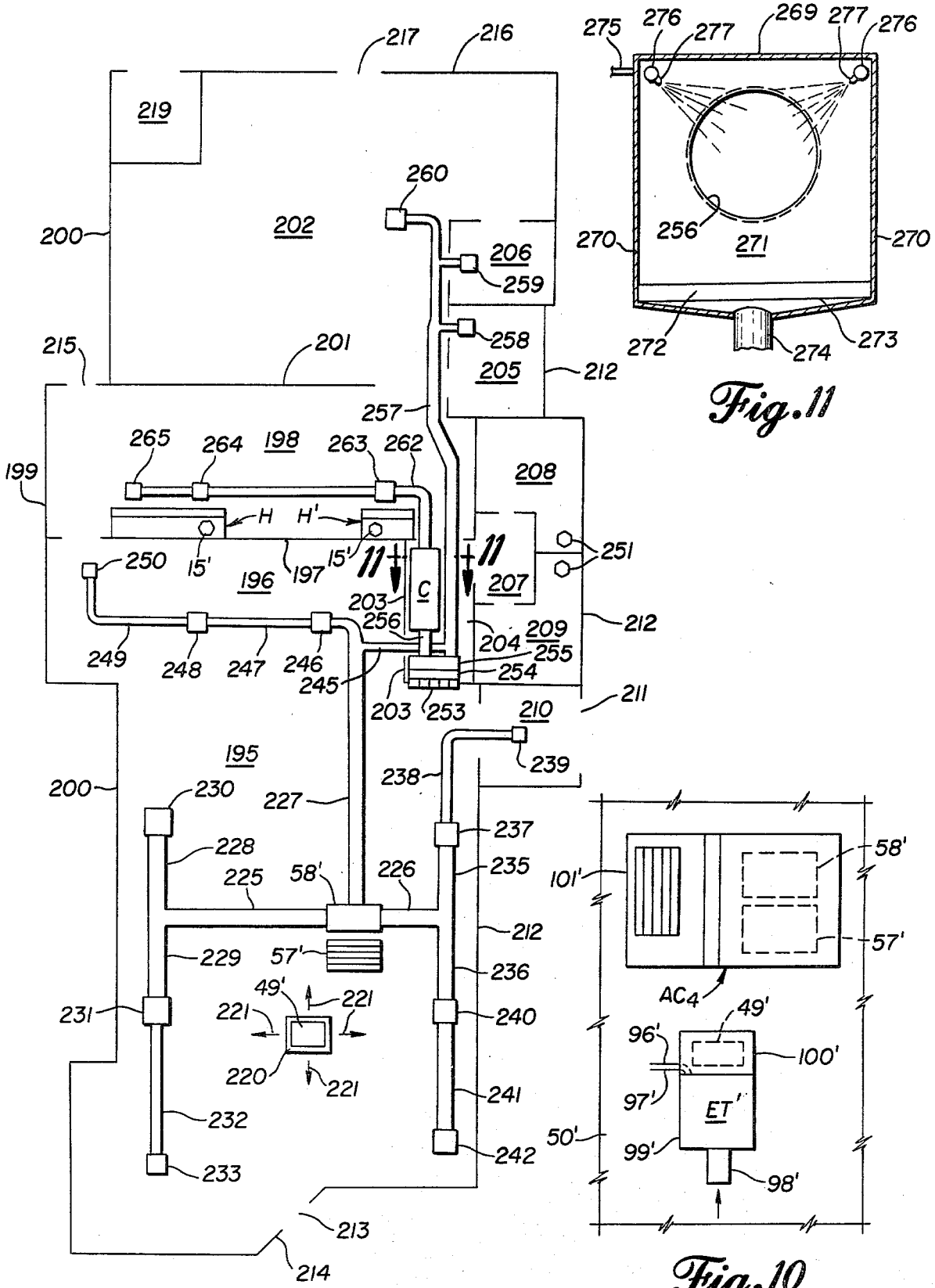
FIG. 9 is a diagrammatic top plan view similar to FIG. 1 but illustrating a slightly different arrangement of a building particularly adapted for use for restaurant purposes, and including a modification of the equipment and method of FIG. 1.
FIG. 10 is a diagrammatic plan view similar to FIG. 2 but also illustrating equipment ancillary to the equipment of FIG. 9.
FIG. 11 is a vertical section, taken along line 11—11 of FIG. 9 and on an enlarged scale, showing a modified air and water chilling device.

As illustrated in FIGS. 9–11, a modification of the embodiment illustrated in FIG. 1 may be utilized for a different style of restaurant arrangement having, as a first space, a rectangular dining room 195 with a food service area 196 between the dining room and a partition 197. The latter separates a cooking room 198, as a second space, which has cooking equipment and a pair of hoods H' and H' over the cooking equipment, each similar to hood H of FIG. 5. A door between the end of partition 197 and an offset 199 in a rear wall 200 provides access to the cooking room, although partition 197 has openings in the portion thereof between hoods H' and H' for passage of prepared food to the food service area. Behind cooking room 198, separated by a partition 201, is a receiving and storage area 202, while a partition 203 having a door opening therein flanks food service area 196 and extends to partition 197, but a door across a corridor 204 coinciding in position with partition 197 separates the cooking room from the dining area. Of course, the suction of the hoods, exerted through exhaust ducts 15', maintains a flow of some air into the cooking room and prevents cooking odors from permeating the dining room. Other rooms include an office 205, a dressing room 206 and an entrance area 207 to sanitary facility rooms 208 and 209, which, along with receiving and storage area 202, comprise a third space. A front foyer 210, having a front entrance 211 in an offset in front wall 212, with suitable doors in the entrance space shown, provides access to the dining room from the outside, as does also a side entrance 213 in a side wall 214, while a rear entrance 215 provides access directly to the cooking room 198. In the opposite side wall 216 is an entrance 217, to storage area 202, as well as an entrance to an equipment room 219. Fresh air is provided to the dining room through a ceiling grille 220, which may be square in shape, connects with the lower end of a fresh air duct 49' and is provided with louvers in its four side walls to direct fresh air in four directions, as indicated by the arrows 221, along the underside of the ceiling, so that the fresh air will mix with treated, recirculated air hereinafter referred to. Duct 49' extends from the ceiling upwardly to an energy transfer unit ET, conveniently mounted on the roof 50' above, as in FIG. 10, and having an air intake 98', a housing 99' and a discharge section 100' to which duct 49' is connected. Also, a heat transfer liquid, such as water or a nonfreezing solution, may be supplied to unit ET' through a pipe 96' and returned through a pipe 97'. A duct 58' which extends upwardly from above the ceiling and through the roof to an air conditioning unit $AC_4$, as in FIG. 10, supplies treated air to the dining room, front foyer and food service area, while air is recirculated from the dining room through a grille 57' in the ceiling and generally in the center of the dining room and to the unit $AC_4$, which may be provided with a grille 101' for cooling purposes. The air is circulated from grille 57' through the air conditioning unit for cooling or heating, as the case may be.

From the lower end of duct 58' air is transferred through pipes above the ceiling, such as a pipe 225 extending to one side and a pipe 226 extending to the opposite side, as well as a pipe 227 extending toward the food service area 196. Branch pipes 228 and 229 extend in opposite directions from the end of pipe 225, with pipe 228 extending to a ceiling grille 230 and pipe 229 extending to a ceiling grille 231 and thence, as a smaller pipe 232, to a smaller ceiling grille 233. Each of the above grilles are near the wall 200. Branch pipes 235 and 236 extend in opposite directions from the end of pipe 226 with pipe 235 extending to a ceiling grille 237 and then, as a pipe 238 of reduced size, to a ceiling grille 239 adapted to deliver air into the foyer. Similarly, pipe 236 extends to a ceiling grille 240 and, as a smaller pipe 241, to a smaller ceiling grille 242. Similarly, distribution pipe 227 extends past a branch pipe 245, whose purpose will be described below, to a ceiling grille 246 and thence, as a pipe 247 of reduced size, to a ceiling grille 248 and, as a pipe 249 of further reduced size, to a ceiling grille 250, with the grilles 246 and 248 being near or above the boundary between the dining room 195 and the food service area 196. Exhaust fan connections 251 withdraw air from the sanitary facility rooms 208 and 209, also inducing a flow of treated air into these rooms.

In accordance with this invention, a grille 253 is mounted above the doorway or opening leading to corridor 204 to permit the inflow of air from a position adjacent one edge of the dining area through a duct 254 to a transfer fan 255 above the ceiling. The flow of air produced by transfer fan 255 is split into two portions, i.e. a larger portion, such as two thirds, through a pipe 256 to a chilling device or chiller C and a smaller portion, such as one third, to a pipe 257. A portion of the air flow to pipe 257, such as 40%, may be supplied through branch pipe 245, such as by a conventional venturi arrangement or a booster blower in the pipe. Pipe 257 diminishes in size consecutively as it extends past branches connected with several ceiling grilles. These grilles include a ceiling grille 258 for the office 205, a ceiling grille 259 for dressing room 206, and a ceiling grille 260 for storage area 202. From the chiller C, a pipe 262 leads to a ceiling grille 263 in the cooking area adjacent hood H'', thence, after a reduction in size, to ceiling grilles 264 and 265 adjacent the hood H'. The purpose of the transfer fan 255 is twofold, first, to utilize air which may be slightly higher in temperature than that supplied to the dining area, but still adequate for the working and service areas, as well as to supply similar air to the cooking area but first cooling the air by passage through chiller C by which the air is cooled through contact with water, as to within a few degrees of its dew point, such cooled air being utilized for cooling purposes in the cooling area in which the heat generated by the cooking equipment requires cooling for the comfort of anyone engaged in cooking operations, although a higher temperature, such as b 80°, is normally unobjectionable in the cooking area.

In further accordance with this invention, the water contacted by the air passing through the chiller C, which may be cooled to a temperature within a degree or two of the dew point, may be transferred to and returned from the energy transfer unit ET', as before, either directly or through an intervening heat exchanger which, in turn, supplies unit ET' with a non-freezing solution. As before, heat exchangers installed in hoods H' and H, similar to those in the hood H, as in FIG. 5, may provide heated water for producing heating of incoming fresh air in unit ET', either directly or through an intermediate heat exchanger which heats a non-freezing transfer liquid for circulation through unit ET'. Although it will be understood that cooling by the chilled water from chiller C may also be utilized for recirculated air, an advantage of cooling incoming fresh air is that, when cooling is required, the outside air is more than likely warmer than the inside air to be recirculated, thereby reducing the load on air conditioner $AC_4$ by cooling air with a higher temperature differential through a cooling fluid which is available, in any event. Also, the use of room air to be water cooled for discharge into a cooking area is advantageous in those areas in which the relative humidity is high during the summer months, since air conditioning unit $AC_4$, as well as units $AC_1$, $AC_2$ and $AC_3$ of FIG. 2, may also be appropriately equipped to remove moisture condensed by cooling and the room air will thus have a lower humidity than the outside air.

The energy transfer unit ET', as before, may be provided with a housing 99' in which are installed the air to liquid heat exchangers for cooling the fresh air flowing through an inlet 98', as indicated by the arrow, and further includes a fan which moves the cooled fresh air through duct 49' into the dining area below. It will be understood, of course, that the cooling of the transfer air for use in the cooking area and consequent operation of the chiller C is accomplished only when the outside temperature is such that incoming air should be cooled. This is principally during the summer months, although, depending on the climate, it may extend from some time in the spring to some time in the fall. It will also be understood that, even though the outside temperature is no higher than the desired temperature in the establishment, it may be desirable to cool the transfer air for the cooking area by operating the chiller, and also cool the incoming fresh air, to minimize the amount of energy which might be required by the air conditioning unit $AC_4$, in order to remove heat produced in the dining area by the mere presence of the occupants thereof. However, during winter months, and perhaps during certain days or evenings during the spring and fall, when it is desirable to heat the incoming air, as well as to heat the air recirculated to the dining area to compensate for heat losses, the energy transfer unit ET' may be operated on a liquid heated by heat exchangers installed in the hoods H' and H, to extract heat from the heated gases and air rising from the cooking equipment, such as the heat exchangers 128 shown in the hood H of FIG. 4. Thus, the pipes 96' and 97' not only carry chilled water to the energy transfer unit, but also water heated by the heat exchangers in the hoods. When the energy transfer unit for treating incoming fresh air is installed on the roof, or any other position in which cold air circulated therethrough might tend to freeze water, a non-freezing solution, such as ethylene glycol, may be substituted as the heat transfer liquid, as described previously. The air conditioning unit $AC_4$ is similar to those previously described, such as including a heat pump type of device for cooling of a suitable liquid which is circulated through heat exchangers for cooling air supplied to them from grille 57' and impelled by a fan through the heat exchangers and returned through duct 58'. A grille 101' on the unit is utilized for cooling purposes, as before, such as to prevent the motor or motors driving the heat pump from overheating, particularly when in use for cooling, or to cool a condenser when the heat pump is used for refrigeration, and the like. The heat pump used for cooling may be reversed, in the winter, to produce heat electrically or the unit $AC_4$ may include a furnace, for heating purposes in cold weather and adapted to burn gas or other fuel.

The chiller C of FIG. 9, as in FIG. 11, may be generally square in cross-section, having a top 269, sides 270, end walls 271 and a bottom 272 which slopes toward a sump 273, from which an outlet pipe 274 leads the chilled water to a point of use. Return water may be supplied through an inlet pipe 275 to a pair of distributing pipes 276 in the upper corners of the chiller, with a series of nozzles 277 mounted on each pipe 276 and extending toward the opposite lower corner. Each nozzle produces a fan-shaped spray so as to cover the interior of the chiller and contact air which enters through air inlet 256 from fan 254 in front end wall 271, the air being discharged into pipe 262 through a corresponding air outlet in the rear end wall.

Although different embodiments of the method and apparatus of this invention have been illustrated and described, it will be evident that other embodiments may exist and various changes made therein, all without departing from the spirit and scope of this invention.

What is claimed is:

1. A method for supplying treated air to a first space and a second space, wherein air may be transferred from said first space to said second space and said second space requires additional cooling of the transferred air and contains cooking equipment and means for removing heated gases and products of cooking from above said cooking equipment, which comprises:

cooling fresh air and supplying the same to said first space;

removing a first portion of air from said first space, cooling said first portion and reintroducing said cooled first portion into said first space as treated, recirculated air;

removing a second portion of air from said first space and passing at least a part of said second portion into engagement with water, so as to chill said water and also cool said air of said part of said second portion;

introducing said cooled part of said second portion of air into said second space;

passing the water chilled by engagement with said part of said second portion in heat exchange relationship with air to be introduced into said first space; and alternatively transferring heat from said heated gases and products of cooking to a heat transfer liquid and passing said heat transfer liquid in heat exchange relationship, directly or indirectly, with said incoming fresh air.

2. A method as defined in claim 1, which includes:

passing said chilled water in heat exchange relationship with said fresh air to be introduced into said first space.

3. A method as defined in claim 1, which includes:

mixing said fresh air and said cooled first portion prior to supplying to said first space.

4. A method as defined in claim 1, which includes:

removing said second portion of air from said first space at a position spaced from the area of introduction of a major portion of said fresh air and treated recirculated air to said first space.

5. A method as defined in claim 1, which includes:

passing a second part of said second portion to a third space.

6. A method as defined in claim 5, which includes:

transferring a part of said mixture of fresh air and cooled first portion to mix with said second part of said second portion of air removed from said first space.

7. A method as defined in claim 1, which includes:

passing said second portion of air from said first space to a third space and transferring a portion of air from said third space to engagement with water for cooling and subsequent transfer to said second space.

8. Apparatus for supplying treated air to a first space and a second space, wherein air may be transferred from said first space to said second space and said second space requires additional cooling of the transferred air, which comprises:

means for cooling fresh air comprising an energy transfer unit having a heat exchanger for alternatively heating and cooling said fresh air through heat exchange with a heat transfer liquid;

means for supplying said fresh air to said first space;

means for removing a first portion of air from said first space including at least a grille and a duct extending to an air conditioning unit having means for alternatively heating and cooling said removed air;

means for cooling said first portion;

means for reintroducing said cooled or heated first portion into said first space as treated, recirculated air;

means for removing a second portion of air from said first space and passing at least a part of said second portion to a chiller having means for causing engagement of said air with water, so as to chill said water and also cool said air of said part of said second portion;

means for introducing said cooled part of said second portion of air into said second space;

means for passing the water chilled by engagement with said part of said second portion to said heat exchanger of said energy transfer unit;

said second space having cooking equipment and a grease extraction ventilator above said cooking equipment for removing heated gases and products of cooking;

heat exchange means for transferring heat from said heated gases and products of cooking to a heat transfer liquid; and means for supplying said fresh air heat exchanger with a cooled or heated heat transfer liquid, alternatively, which respectively derives cooling properties from said water chilled in said chiller and heating properties from said water heated by said heated gases and products of cooking.

9. Apparatus as defined in claim 8, which includes:

at least one plenum for mixing said fresh air and said cooled first portion prior to supplying the same to said first space.

10. Apparatus as defined in claim 8, which includes:

means for passing a second part of said second portion to a third space.

11. Apparatus as defined in claim 10, which includes:

means for transferring a part of said mixture of fresh air and cooled first portion to mix with said second part of said second portion of air removed from said first space.

12. Apparatus as defined in claim 8, which includes:

means for passing said second portion of air from said first space to a third space;

means for transferring a portion of air from said third space to a chiller for engagement with water for cooling said air and chilling said water; and means for supplying said cooled air to said second space.

13. Apparatus as defined in claim 8, wherein:

said chiller is mounted on said grease extraction ventilator for delivering cooled air directly into said cooking area.

14. Apparatus as defined in claim 8, wherein:

said first space includes at least a grille and a duct extending to an air conditioning unit having means for alternatively heating and cooling said removed air;

said means for removing said second portion of air from said first space includes a grille and a transfer fan;

said means for cooling fresh air comprises an energy transfer unit having a heat exchanger for alternatively heating and cooling said fresh air through heat exchange with a heat transfer liquid;

said second space has cooking equipment and a grease extraction ventilator above said cooking equipment for removing heated gases and products of cooking;

said chiller is mounted exteriorly of said cooking area; and said chiller is connected to a duct for supplying cooled air to said cooking area.

* * * * *

UNITED STATES PATENT OFFICE

CERTIFICATE OF CORRECTION

PATENT NO. : 4,285,390
DATED : August 25, 1981
INVENTOR(S) : Dennis M. Fortune and Victor D. Molitor It is certified that error appears in the above-identified patent and that said Letters Patent are hereby corrected as shown below:

Claim 14 should read as follows:

--14. Apparatus as defined in claim 8, wherein:

said chiller is mounted exteriorly of said cooking area and said chiller is connected to a duct for supplying cooled air to said cooking area.--

Signed and Sealed this

*Twenty-fourth* Day of *November 1981*

[SEAL]

*Attest:*

GERALD J. MOSSINGHOFF

*Attesting Officer*

*Commissioner of Patents and Trademarks*